US006077172A

United States Patent [19]

Butler

[11] Patent Number: 6,077,172

[45] **Date of Patent: *Jun. 20, 2000**

[54] METAL WOOD GOLF CLUB HEAD HAVING A SHAFT ATTACHMENT AT THE SOLE

[76] Inventor: Byron Butler, 2 Siega, Rancho Santa Margarita, Calif. 92688

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/742,737

[22] Filed: Nov. 1, 1996

[51] Int. Cl.[7] ..... A63B 53/02; A63B 53/04

[52] U.S. Cl. ..... 473/305; 473/345; 473/310

[58] Field of Search ..... 473/343, 345, 473/305, 306, 310, 312, 307, 308, 309, 311, 313, 314, 315, 324, 346

[56] References Cited

U.S. PATENT DOCUMENTS

| | | | |
|---|---|---|---|
| 3,810,621 | 5/1974 | Mills . | |
| 5,232,224 | 8/1993 | Zeider | 473/345 |
| 5,301,945 | 4/1994 | Schmidt | 473/328 |
| 5,335,909 | 8/1994 | Green | 473/305 |
| 5,452,890 | 9/1995 | Bingman | 473/311 |
| 5,575,723 | 11/1996 | Take . | |
| 5,797,806 | 8/1998 | Butler . | |

FOREIGN PATENT DOCUMENTS

| | | |
|---|---|---|
| 2225725 | 6/1990 | United Kingdom . |
| 2230459 | 10/1990 | United Kingdom . |

*Primary Examiner*—Sebastiano Passaniti
*Attorney, Agent, or Firm*—Leonard Tachner

[57] ABSTRACT

A metal wood golf club head providing a shaft attachment to the interior of the head at the interior surface of the sole, permits an unencumbered face surface even adjacent the heel. The resulting head provides improved off-center shots in an external configuration that has no hosel.

3 Claims, 3 Drawing Sheets

METAL WOOD GOLF CLUB HEAD HAVING A SHAFT ATTACHMENT AT THE SOLE

FIELD OF THE INVENTION

1. Field of the Invention

The present invention relates generally to the field of golf clubs and more particularly to metal wood golf club heads in which the shaft attachment is uniquely made at the sole plate in the interior of the club head.

2. Prior Art

All conventional metal wood golf club heads employ a hosel to provide an attachment means for securely connecting the head to a shaft. Normally, the hosel extends upwardly from the top surface adjacent the club head face. The shaft typically extends at least partially into the interior of the head within the hosel structure, the latter being affixed or made integral to the interior wall of the club head at the interior region of the interface between the face and the heel of the club head. There are, of course, variations in the structure of conventional hosels as well as in the nature of the interface between the hosel structure and the remainder of the club head. By way of example, U.S. Pat. No. 5,480,152 discloses a very short hosel extension above the top surface of the club head. However, irrespective of such variations, such prior art metal wood golf clubs suffer the disadvantage of reduced ball striking performance whenever the ball is struck at or near the edge of the face closest the heel of the club head. This reduction in performance at that location results from a dampening or deadening of that impact region of the face due to the attachment of the shaft. More specifically, because the shaft and hosel structure are effectively attached or made integral to the heel portion of the face interior, the natural deformation of that portion of the face upon impact with the golf ball is distorted or restricted. The result is a poor golf shot that is usually short and in an unintended direction, sometimes referred to as a shank. The degree of performance reduction depends upon the precise location of impact with the ball. The closer the impact point is to the heel edge of the face, the more effect on performance. However, virtually any impact point that is off center toward the heel, is likely to be diminished by the deadening effect resulting from the structural interference of the hosel/shaft with the face adjacent the heel.

There is therefore a need for a metal wood golf club head design which entirely avoids any and all interference by the shaft/hosel structure with the ball striking face.

SUMMARY OF THE INVENTION

The present invention meets the aforementioned need with a novel attachment between the club head and a shaft. There is absolutely no hosel above the top surface of the golf club head. Instead, there is a passageway through the top surface for which the shaft to pass into the interior of the head. Even more significantly, an interior shaft socket extends up from the interior surface of the sole, providing connection of the shaft directly to the sole plate at a location separated from the face of the club head. Therefore, there is no direct or indirect connection of the shaft or attachment structure to the face, thus leaving the entire face free to respond to ball impact without the deadening or dampening found in conventional metal wood heads. As a result, one may hit straighter and longer shots with the metal wood head of the present invention even when the impact point is toward the heel edge of the hitting surface.

OBJECTS OF THE INVENTION

It is therefore a principal object of the present invention to provide a metal wood golf club head wherein the shaft attaches to the sole and is free of any interference with the face.

It is another object of the invention to provide a metal wood golf club head having improved performance particularly for off-center hits where the impact point is toward the heel edge of the hitting surface.

It is still an additional object of the invention to provide a metal wood golf club head wherein the entire hitting surface, even that portion that is adjacent the heel, is relatively free to deflect upon ball impact.

BRIEF DESCRIPTION OF THE DRAWINGS

The aforementioned objects and advantages of the present invention as well as additional objects and advantages thereof will be more fully understood hereinafter as a result of the detailed description of a preferred embodiment when taken in conjunction with the following drawings in which.

DETAILED DESCRIPTION OF A PREFERRED EMBODIMENT

Figure 1:
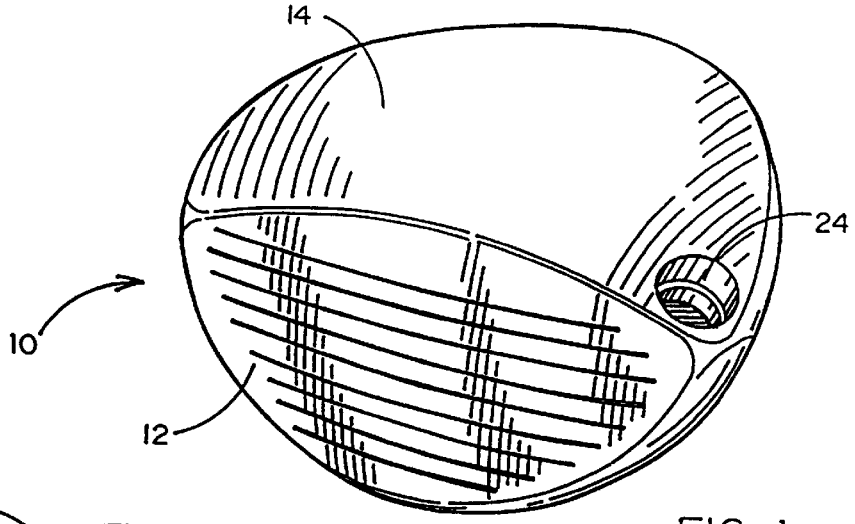
FIG. 1 is a three-dimensional illustration of the metal wood golf club head of the invention.
Figure 2:
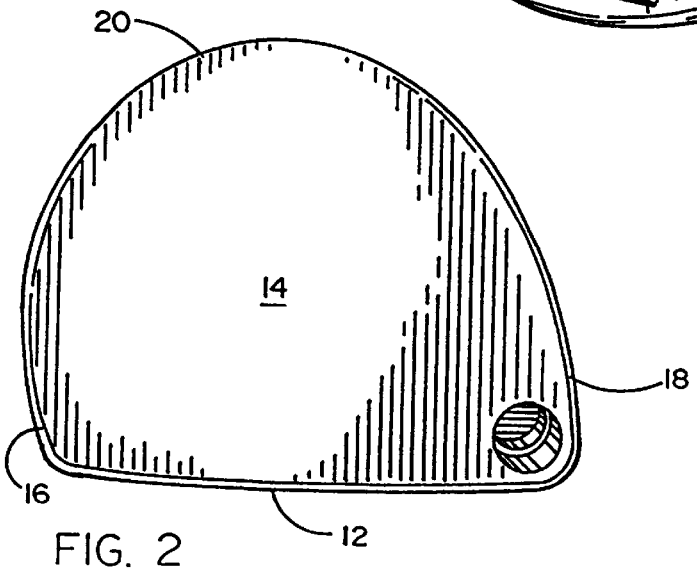
FIG. 2 is a top view thereof.
Figure 3:
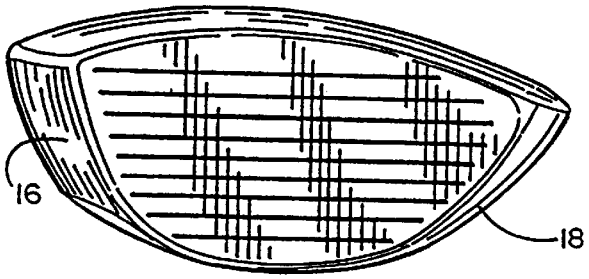
FIG. 3 is a front view thereof.
Figure 4:
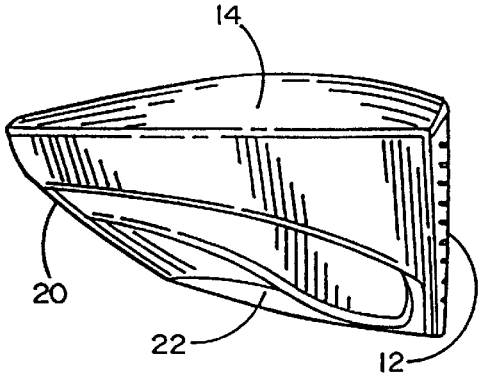
FIG. 4 is a right side view thereof.
Figure 5:
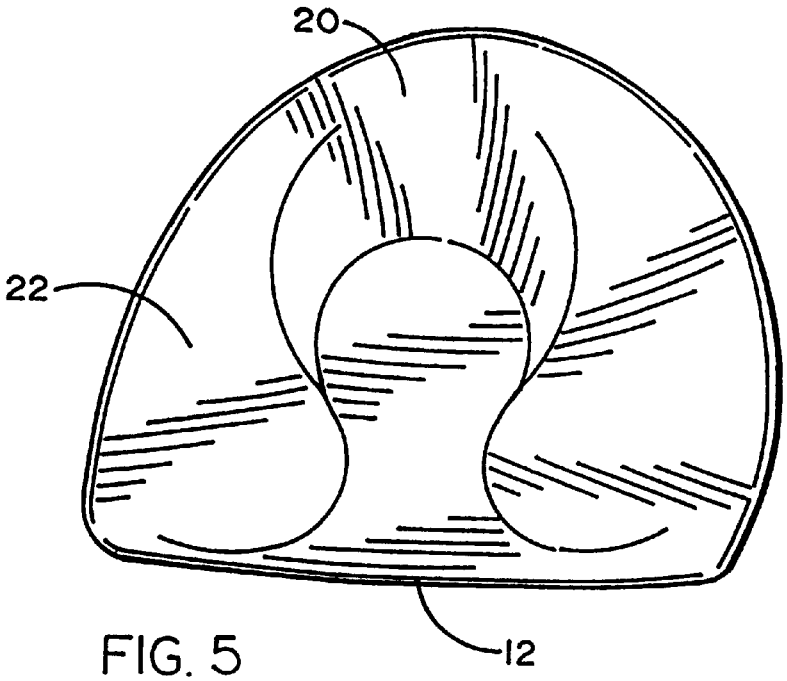
FIG. 5 is a bottom view thereof.
Figure 6:
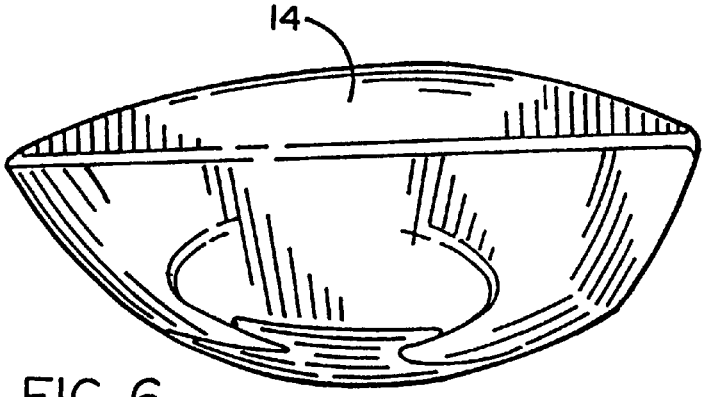
FIG. 6 is a rear view thereof.
Figure 7:
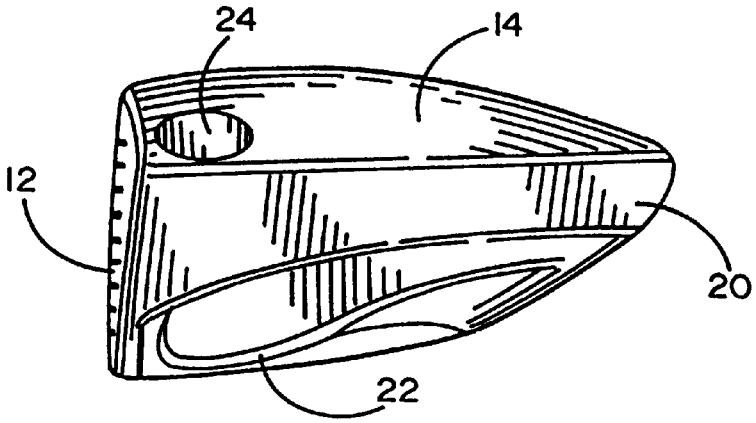
FIG. 7 is a left side view thereof.
Figure 8:
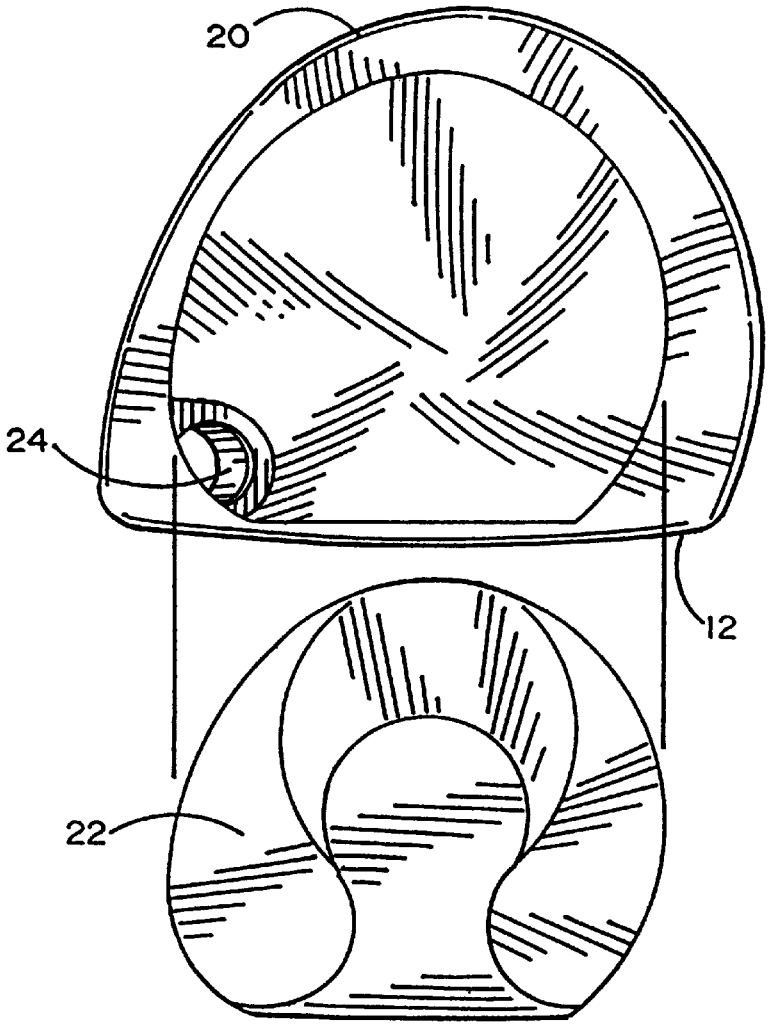
FIG. 8 is an exploded bottom view thereof.
Figure 9:
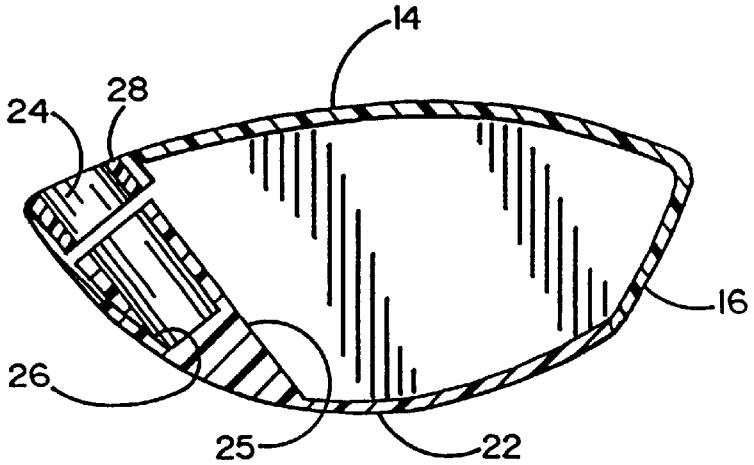
FIG. 9 is a cross-sectional view of the invention.

Referring to the accompanying figures, it will be seen that a golf club metal wood head 10 in accordance with the present invention, comprises a face or hitting surface 12, a top surface 14, a toe 16, a heel 18, a rear surface 20 and a sole 22. Unlike prior art metal wood heads, there is no exterior hosel, but instead there is a passage 24 leading through the top surface 14 into the interior of the head. Within the interior of the head, as seen best in FIG. 9, there is a shaft receptacle 25 integral to and extending upwardly from the inside surface of the sole 22 and forming a hosel-like shaft connection channel 26. Channel 26 terminates just short of passage 24 with which it is coaxial thereby forming a gap therebetween.

A shaft (not shown) is connected to the head by passing its end through passage 24 and inserting it in channel 26 with suitable adhesive such as epoxy. Passage 24 is preferably larger than the shaft through it and may be filled with a rubber-like material 28 around the shaft to permit limited movement of the shaft at ball impact. Because the passage 24 is separated from the face 12 and the receptacle 25 and channel 26 are connected only to the sole 22, there is no restriction on the face 12 by the shaft or any hosel-like structure adjacent the heel 18. Consequently, upon impact of the face with a golf ball, even adjacent the heel, the face is free to deflect without any deadening or dampening that could otherwise result in prior art metal wood heads.

It will now be understood that the present invention provides a novel means for connecting a shaft directly to the interior of the sole of a metal wood head without interfering with the deflection of the face upon impact with a ball, even at or near the heel/face edge. The inventive head completely obviates any form of external hosel.

Those having skill in the art of golf club head design will now, as a result of the disclosure herein of an exemplary embodiment, perceive various modifications and additions which may be made to the invention. For example, ways other than that shown for affixing a shaft to the interior of the sole, will now likely occur to those having the benefit of the teaching herein. Accordingly, all such modifications and additions are deemed to be within the scope of the invention which is to be limited only by the appended claims and their equivalents.

I claim:

1. A metal wood golf club head having a substantially enclosed substantially empty hollow interior and comprising a top surface having no hosel and having a passage into the interior of said head for receiving a shaft for connection of the shaft to the head within said interior; said passage being larger than said shaft to permit limited movement of the shaft;

a receptacle within the interior of said head for coaxial attachment to said shaft, said receptacle being axially aligned with and spaced from said passage forming a gap therebetween and fully exposing said shaft along at least a portion thereof;

said receptacle being affixed to the interior surface of the sole of said head;

said receptacle being spaced from the interior surface of the face of said head.

2. The golf club head recited in claim 1 wherein said receptacle is integrally formed with the interior surface of said sole of said head.

3. A metal wood golf club head having a face, a top surface, a sole, a heel and a toe all forming a substantially enclosed structure having a substantially empty hollow interior; the head comprising:

a shaft receptacle attached to said sole within said interior and a passage through said top surface and aligned with said shaft receptacle;

said top surface being hoselless and said passage being larger than a shaft received in said receptacle to permit limited movement of said shaft;

said shaft receptacle being spaced from said face and from said passage, the spacing between said shaft receptacle and said passage forming a gap therebetween and fully exposing said shaft along at least a portion thereof.

* * * * *